United States Patent [19]

Knauer

[11] Patent Number: 4,935,623

[45] Date of Patent: Jun. 19, 1990

[54] PRODUCTION OF ENERGETIC ATOM BEAMS

[75] Inventor: Wolfgang Knauer, Malibu, Calif.

[73] Assignee: Hughes Aircraft Company, Los Angeles, Calif.

[21] Appl. No.: 363,229

[22] Filed: Jun. 8, 1989

[51] Int. Cl.[5] ..... H05H 3/00

[52] U.S. Cl. ..... 250/251; 250/281; 250/282; 250/288

[58] Field of Search ..... 250/251, 281, 282, 288

[56] References Cited

U.S. PATENT DOCUMENTS

| | | | |
|---|---|---|---|
| 3,466,442 | 9/1969 | McKibben et al. | 250/251 |
| 3,700,899 | 10/1972 | Kaminsky | 250/251 |
| 3,723,741 | 3/1973 | Von Ehrenstein | 250/251 |
| 3,742,219 | 6/1973 | Damm et al. | 250/251 |
| 4,649,273 | 3/1987 | Chutjian et al. | 250/251 |
| 4,713,542 | 12/1987 | Campana | 250/251 |
| 4,734,622 | 3/1988 | Stein | 250/251 |
| 4,737,637 | 4/1988 | Knauer | 250/281 |
| 4,780,608 | 10/1988 | Cross et al. | 250/281 |
| 4,833,319 | 5/1989 | Knauer | 250/251 |

*Primary Examiner*—Janice A. Howell
*Assistant Examiner*—Kiet T. Nguyen

[57] ABSTRACT

Beams of energetic atoms are produced by furnishing a beam of energetic ionized clusters and disintegrating the clusters to produce a beam of energetic atoms. The energetic ionized clusters are provided by forming a beam containing uncharged particles, both clusters and atoms, ionized the particles, accelerating the particles, separating any unionized particles from the beam, and removing those particles outside a selected size range from the beam. The resulting energetic beam of ionized clusters is impacted against a cluster scattering plate so that the clusters break apart into unclustered atoms and ions. The ions are removed from the beam of unclustered atoms, which is available for use as needed. The atoms have energies dependent upon the cluster beam conditioning, but which are typically in the range of 1–10 electron volts per atom.

17 Claims, 2 Drawing Sheets

PRODUCTION OF ENERGETIC ATOM BEAMS

BACKGROUND OF THE INVENTION

This invention relates to the production of beams of energetic atoms, and, more particularly, to such production by forming and then disintegrating an energetic cluster beam.

The deposition of thin films upon substrates is an important manufacturing and research tool in a variety of fields. For example, microelectronic devices are prepared by depositing successive film layers onto a substrate to obtain specific electronic properties of the resulting structure. Photosensitive devices such as vidicons and solar cells are manufactured by depositing films of photosensitive materials onto substrates. Optical properties of lenses are improved by depositing films onto their surfaces. These examples are, of course, only illustrative of the thousands of applications of thin film deposition techniques.

In the highly controlled approach to thin-film deposition that is characteristic of applications wherein a high quality film is required, the film is built up by successive deposition of monolayers of the film, each layer being one atom thick. The mechanics of the deposition process can best be considered in atomistic terms. Generally, in such a process the surface of the substrate must be carefully cleaned, since minor contaminant masses or even contaminant atoms can significantly impede the deposition of the required highly perfect film. The material of the film is then deposited by one of many techniques developed for various applications, such as vapor deposition, sputtering, chemical vapor deposition, or electron beam evaporation.

In these and other atomistic techniques, matter and energy are supplied to the surface by particle beams, which can include ions, atoms, clusters, or some combination thereof. The particles in the beam may deposit upon the surface of the target, causing the gradual, layer-by-layer increase in thickness. The particles in the beam may also provide energy to the surface, and a carefully controlled energetic contribution has been shown to improve the perfection of the growing film.

The production of well controlled, energetic ion, ionized cluster and atom beams is therefore a key part of such processes. A number of techniques are known for producing ion and ionized cluster beams. The energy of the ions and ionized clusters of such beams is controllable to a good degree of accuracy, so that the particles in the beam have a narrow distribution in energies about a central value. Such control is possible largely because ionized particles react in a known way with electrostatic fields produced by accelerating electrodes provided within the deposition apparatus, and the magnitude of the field intensity governs the energy of the particles in the beam.

The production of well controlled, energetic atom beams is more difficult. Atoms do not interact with electrostatic fields in the apparatus, and therefore cannot be acceler158 the same manner as can ionized particles. In the normal practice for providing an atom beam, the atom particles in the beam must be produced and accelerated to a desired energy level by some physical means. As an example, a physical vapor deposition source produces a beam of atoms from a hot mass of the material to be vaporized, and the beam escapes from the source through an aperture. These atoms are not very energetic, typically with energies of about 1/10 electron volt per atom, and the energy cannot be readily increased by manipulation of the beam. In another approach, a beam can be produced by igniting a plasma that expands and imparts kinetic energy to atoms, propelling them toward a target. In this case the process is not well controlled, and there can be a wide range of energies in the atoms of the beam.

It would be desirable to have an approach for producing an energetic, bright beam of atoms wherein the atoms have energies on the order of 1 to 10 electron volts per atom. A source of such a beam would be useful in a wide variety of areas related to production of thin films, and also possibly in space propulsion and fusion reactors. The present invention fulfills this need, and further provides related advantages.

SUMMARY OF THE INVENTION

The present invention provides an approach and apparatus for producing a beam of well controlled, energetic atoms having a high beam brightness. Beams of a wide variety of solid and gaseous materials, in an atomic, unionized state, can be produced in apparatus that is similar in some general features to, but distinct from, existing beam-production apparatus. The beam of atoms is readily controlled as to its energy distribution, beam shape, and composition over a wide range of parameters.

In accordance with the invention, a process for producing a beam of energetic atoms comprises the steps of providing a beam containing energetic ionized clusters; and disintegrating the clusters of the beam to produce a beam of energetic atoms and energetic ions.

A feature of the present invention is that a beam of atoms is produced by first forming ionized clusters of those atoms, conditioning the cluster beam to a particular composition, energy, and energy distribution using techniques applicable to charged particles, and then disintegrating the cluster into a beam of atoms.

The present approach has the advantage that the character of the final atom beam may be controlled through techniques associated with control of ion and ionized cluster beams. These include, for example, mass separation and acceleration procedures using electrostatic fields. The ionized cluster beam is conditioned to a state so that the atom beam resulting from the forward scatting of the cluster beam is also well conditioned. Other features and advantages of the invention will be apparent from the following more detailed description of the preferred embodiment, taken in conjunction with the accompanying drawings, which illustrate, by way of example, the principles of the invention.

DETAILED DESCRIPTION OF THE INVENTION

Techniques are known for forming cluster beams of both materials that are volatile (gaseous) and materials that are non-volatile (solid or liquid) under particular source and target conditions. The clusters of the beams are ionized, as by a cathode/anode ionizer and accelerated to a particular energetic state, as by apertured electrodes through which the beam passes. (The term "energetic" as used herein means that the particles of the beam have been accelerated by a field to an energy level determined by the accelerating potential. The energy of a particle is directly related to its mass and velocity.)

The energy distribution of the beam may be established using known mass separator techniques, wherein particles less than a particular mass are retarded and separated from the beam by an electrostatic field. Unionized particles, which may be produced by the source but do not have the well controlled beam energy distribution, are separated from the beam by deflecting the ionized beam slightly using a deflector electrode. The resulting energetic ionized cluster beam is well controlled in the sense that its composition, cluster size, cluster energy, energy per atom, beam shape, and beam direction are all well established by the operating parameters of the apparatus. Most of the particles in the beam are singly ionized clusters having a selected number of atoms per cluster.

The ionized cluster beam is disintegrated into a beam that contains energetic atoms. The preferred approach for accomplishing the disintegration is directing the cluster beam against an obstacle, thereby utilizing some of the kinetic energy of the beam to cause the cluster to break apart. It is observed that for clusters having energies greater than about 1 electron volt per atom, the clusters break apart largely into atoms and unclustered ions. The ions are readily removed from the atom beam with an electrostatic deflection plate, leaving a beam that has a relatively high energy per atom, and a relatively high brightness (number of atoms per unit area and unit space angle of the beam).

The preferred obstacle for accomplishing the disintegration is a cluster scattering plate that is oriented to the beam axis at an angle of greater than zero up to about 20 degrees. The impact of the energetic cluster beam upon the surface of the plate produces a forward-scattered beam of atoms whose direction of flight is generally the same as, but altered somewhat from, the original direction of the beam. The ionized cluster beam strikes the plate at an incidence ranging from a grazing angle to a somewhat higher angle. Little of the kinetic energy per atom of the atoms in the direction parallel to the surface of the plate is lost, while the energy perpendicular to the surface of the plate provides the energy to disintegrate the cluster. The resulting beam of energetic atoms can be used for any required purpose.

Figure 1:
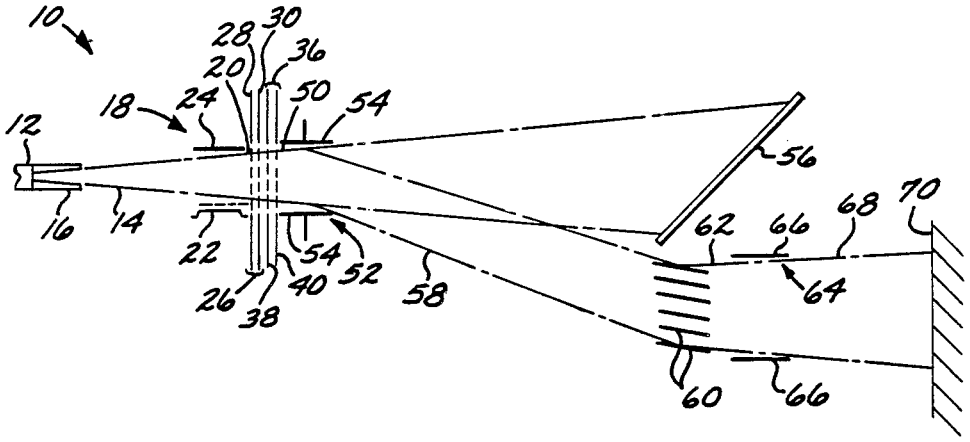
FIG. 1 is a schematic elevational view of apparatus for producing an atom beam.

The present invention is embodied in an atom beam production apparatus 10 illustrated in FIG. 1. The deposition apparatus 10 includes a cluster source 12 which produces a cluster beam 14. The cluster beam 14 includes clusters of loosely bound atoms and unclustered single atoms, collectively termed particles herein, with the distribution of atoms and clusters determined by the construction of the source and the type of atoms produced. The velocities of the clusters and atoms are generally uniform, because of the manner in which the source operates.

In one type of source, atoms are heated in a crucible and emitted from an opening in the top of the crucible. A fraction of the atoms naturally cluster together, but the clustering efficiency of this type of source is low. In another type of source 12 illustrated in FIG. 1, clusters are formed by passing a pressurized gas of volatile atoms to be clustered through a sonic or supersonic nozzle 16. Clusters are formed when the gas expands and cools. The velocity of the atoms and clusters is relatively uniform upon ejection from the nozzle 16.

The particles of the cluster beam 14 are not ionized when it emerges from the cluster source 12, but must be ionized so that they can be electrostatically accelerated. The particles of the cluster beam are ionized in an ionizer 18 to form an ionized cluster beam 20. In most instances, it is preferred to ionize the particles positively, and the following description is directed to an ionizer 18 that produces positive ionization of the particles. Electrons are emitted from a cathode 22 toward an anode 24 having an applied positive potential. The path of the electrons is transverse to and intercepting the line of flight of the particles of the previously unionized cluster beam 14. Some of the electrons hit the particles, and the particles become positively charged. Preferably, the positive potential of the anode 24 is about 50 to about 100 volts, and the ionizer current is about 10 to about 30 milliamps. Under these conditions of operation, many particles, whether atoms or clusters, become singly ionized. It is convenient to consider each ionized cluster itself as being charged, and to continue to speak of atoms, rather than ions, as comprising the clusters. The low level of ionization for each cluster is required so that the cluster may be controllably accelerated by an electrostatic accelerator.

The ionized cluster beam 20 contains ionized unclustered atoms, ionized clusters, and unionized atoms and clusters. The presence of the unionized atoms and clusters is of little consequence, since these particles are not electrostatically accelerated and never become energetic. It is, however, preferred to separate the unclustered ionized atoms and small ionized clusters from the larger ionized clusters, so that when the larger ionized clusters are accelerated, all accelerated particles will be of about the same kinetic energy.

A mass separator 26 reflects and rejects ionized atoms and ionized clusters of small size, so that they cannot pass through the mass separator. Such a mass separator and its operation are described in U.S. Pat. No. 4,740,267, whose disclosure is incorporated by reference. In the preferred embodiment illustrated in FIG. 1, the mass separator 26 comprises two electrodes placed in the path of the ionized cluster beam 20. An entrance electrode 28 is positioned nearest to the ionizer 18, while a retarding field electrode 30 is placed further from the ionizer. The retarding field electrode 30 electrostatically produces a retarding field when a voltage equal in sign to the ionization of the particles is applied to the electrode 30. This retarding field should be as uniform as possible, since nonuniformities permit particles of different masses to pass and also tend to decollimate the ionized cluster beam 20. The retarding filed electrode 30 should also permit a large fraction of the ionized cluster beam 20 to pass therethrough. Preferably, the configuration of the electrode 28 and the electrode 30 is somewhat like that of fishnet or window screening. The retarding field is substantially the same for each aperture therein, although there is some minor variation across the dimension of the aperture.

The retarding field potential produced by the retarding field electrode 30 acts to retard all ions of the ionized cluster beam 20 having the same sign as the voltage applied to the electrode 30. Whether the retardation force is sufficient to prevent a particular particle from passing through the electrode 30 is determined by the kinetic energy of the particle and its degree of ionization. Ionized particles of low mass (and thence low kinetic energy), whatever their degree of ionization, are strongly retarded. The result is that all ionized but unclustered atoms are retarded strongly under the field of the retarding field electrode 30, and are repelled from the electrode 30 back toward the cluster source 12. Also, ionized clusters having a mass less than a selected value determined by the applied voltage are retarded strongly and repelled back toward the cluster source 12. As stated earlier, unionized atoms and clusters are not affected by the retarding field. However, the energies of these unionized particles are low when emitted from the cluster source 12, and the unionized particles are not accelerated by a subsequent electrostatic accelerator. Thus, the result of the application of a sufficiently large retarding field is that substantially no ionized particles having a mass less than that of the selected mass can pass through to the target substrate.

The properly sized clusters having masses greater than the selected value pass to an accelerator 36. In the accelerator 36, a first apertured electrode 38 is maintained at a potential less negative (for positively ionized clusters) than a second apertured electrode 40. The ionized cluster beam 20 passes through the apertures of the electrodes 38 and 40, and the particles are accelerated by the potential difference between the electrodes 38 and 40. The second apertured electrode 40 is typically about 2000 to about 20,000 volts more negative than the first apertured electrode 38, which is permitted to float at the same voltage as the ionizer 18. When a singly charged cluster of 2000 atoms passes through the electrodes 38 and 40 maintained at a voltage difference of 2000 volts, an energy of 2000 electron volts is imparted to the particle cluster, or about 1 electron volt per atom for this example. As used herein, an "energetic" particle is one that has been accelerated to an increased energy state above that produced by the cluster source 12.

The resulting beam 50 of energetic ionized clusters of a mass greater than that repelled by the mass separator 26 also contains a fraction of nonenergetic, unionized atoms and clusters. Because the unionized atoms and clusters are not ionized, they are unaffected by the mass separator 26 and the accelerator 36, but travel in a straight line through these elements. These unionized particles are readily separated from the energetic ionized clusters by passing the beam 50 through a deflector 52. The deflector 52 includes two plates 54 disposed on either side of the beam 50, and across which a voltage potential is applied. The resulting electrostatic field deflects the ionized clusters at an angle to their original path, while the unionized atoms and clusters continue straight to impact against a beam dump 56. The deflected beam 58 is thus highly conditioned to contain almost entirely energetic, singly ionized clusters of a size greater than that established by the retarding potential of the accelerator 36.

The clusters of the deflected beam 58 impact against a cluster scattering plate 60 that is interposed at an angle into the beam 58. Preferably, and as illustrated in FIG. 1, several parallel plates 60 can be used if the beam 58 is wide. The plates 60 may be made of any acceptable material, and silicon has been used with successs. In a working embodiment of the apparatus 10, the plates 60 had a face dimension of 1 inch by 0.25 inch, were 0.10 inch thick, and were made of silicon. Since the beam 58 was 0.75 inch wide, a total of 4 plates were used, spaced 0.2 inch apart.

When the clusters of the beam 50 strike the plate 60 at a shallow angle, they disintegrate into smaller fragments that scatter forwardly to form a forwardly scattered beam 62. It has been experimentally observed that when the energy per atom of the cluster is on the order of a few tenths of an electron volt or less, the fragements are a mixture of atoms, smaller clusters, and a few ions. However, when the energy per atom of the cluster is greater than about one-halt of an electron volt, the forwardly scattered fragments are mostly atoms and a few ions, with fewer small sized cluster fragments. When the energy per atom is more than about one electron volt, the forwardly scattered fragments contain almost no clusters, and are almost entirely atoms with a few ions. To produce a beam 62 that is mostly atoms, it is therefore preferred to operate the accelerator 36 at a sufficiently high voltage that the clusters reaching the plate 60 have an energy per atom of at least about one-half electron volt, and most preferably about one electron volt or more.

The electronic charge previously borne by the clusters in the beam 50 is deposited with individual atoms of the beam 62, which constitute the few ions of that beam. It is desirable in many cases, such as when the beam is directed against a target that is not a good conductor of electricity, to remove the ions from the beam, as the ions would build up a space charge on the surface of the target if they were permitted to penetrate to the target. These ions can be removed from the beam 62 by passing the beam through a deflector 64. The deflector 64 includes two plates 66 disposed on either side of the beam 62. A voltage is applied between the plates 66, which establishes an electrostatic field between the plates. This field deflects the ions present in the beam 62, but does not affect the uncharged atoms that constitute the majority of the beam.

The uncharged atoms form an atom beam 68, which is virtually free of clusters and ions. The atoms in the beam 68 have a distribution of energies, because after acceleration the energy per atom in the clusters varies. The brightness of the beam 68 is high, because there are typically several thousand atoms produced for each cluster disintegrated.

The atom beam 68 may be used for any required purpose, such as impact against the surface of a target 70. The mass of the atoms in the beam 68 is on the same order as that of the atoms in the target 70, and therefore the interaction is more inelastic than in the case where clusters are directed against the surface. As a result, more of the energy of the atoms in the beam is transferred to the atoms of the target, and there is an increased likelihood that the atoms of the beam 68 will stick to the surface of the target 70. Thus, in some cases the use of an energetic beam of atoms is preferred to the use of an energetic beam of clusters, and the present approach provides an approach whereby such a beam of atoms can be produced. The same apparatus, with the changes indicated herein, can be used to deposit either energetic atoms or energetic ionized clusters, simply by removing the plates 60 from the beam 58.

Throughout this discussion, the term "atoms" has been used to describe the particles that make up the clusters, and which eventually reach the surface of the target. The clusters may also be made of small molecules, such as methane molecules, and therefore, as used herein, the term "atoms" is intended to include both single atoms and groups of atoms bound together as molecules, as the term is used in relation to the structure of clusters.

An apparatus has been constructed according to the preceding description to demonstrate the production of a beam of atoms by disintegration of clusters. The structure of this apparatus is that which has been previously described. In an exemplary operation of this apparatus, argon clusters of about 2800 atoms each were provided as the beam 58. In several different trials, accelerator voltages ranging from about 2,000 to about 10,000 electron volts per cluster were used.

Figure 2:
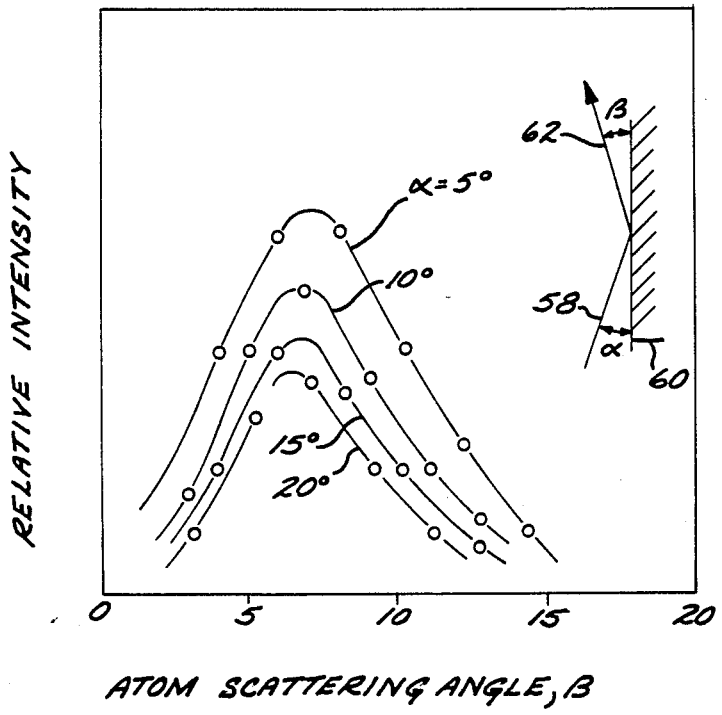
FIG. 2 is a graph of the angular intensity distribution of atoms in the disintegrated beam.

FIG. 2 illustrates the intensity of the forwardly scattered beam 62 as a function of the angle alpha between the deflected beam 58 and the surface of the cluster scattering plate 60, and as a function of the angle beta between the forwardly scattered beam 66 and the surface of the plate 60. (The Greek letters are shown in the figure.) In this case, the accelerating voltage was 4000 volts, so that the energy per atom was about 1.4 electron volts. The maximum intensity of the forwardly scattered beam 62 is found at an angle beta of about 6–8 degrees, for all angles of alpha. The maximum intensity decreases for all values of alpha greater than about 5 degrees, and becomes unacceptably small, for many but not all applications, for angles alpha greater than about 20 degrees. Thus, it is preferred that the angle alpha between the (incoming) beam 58 and the cluster scatter plate 60 be greater than zero but less than about 20 degrees. The angle alpha must be greater than zero to achieve an impact of the clusters against the plate 60. It is believed that the component of the energy of the clusters in the beam 58 perpendicular to the cluster scattering plate 60 provides the energy that causes the clusters of the beam to disintegrate. It is believed that the perpendicular component of energy is converted to heat, that causes the atoms of the cluster to leave the cluster. If the angle alpha is too low, there is insufficient energy to achieve the disintegration, and the forwardly scattered particles will include many more clusters. The larger the value of alpha, the lower will be the energy distribution of the atom beam reaching the target, because more energy is dissipated against the plates 60.

It is further preferred that the angle beta between the surface of the plate 60 and the target 70 be from about 6 to about 8 degrees, for whatever angle alpha is chosen. These preferred angles of alpha and beta may vary slightly depending upon the operating conditions of the apparatus, but in each case may be determined in the manner just discussed.

Figure 3:
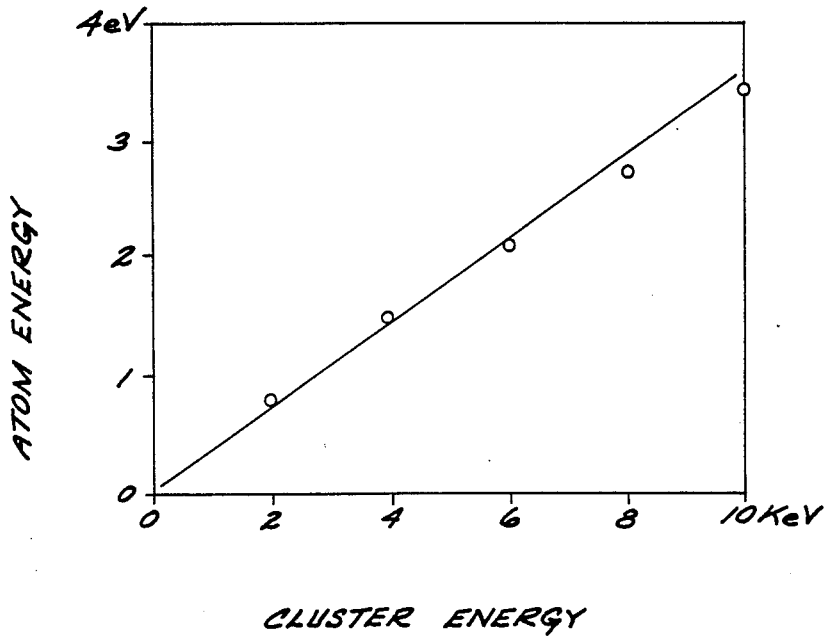
FIG. 3 is a graph of atom energy as a function of cluster energy.

FIG. 3 illustrates the measured energy per atom in the forwardly scattered beam 62 as a function of the accelerating voltage applied to the clusters by the accelerator 36. The clusters were of argon, having about 2800 atoms per cluster. The incident angle alpha was 10 degrees, and the scattered angle beta was 6 degrees. Over the range of accelerating voltages of from about 2,000 to about 10,000 volts, the relationship is nearly linear and close to that predicted by simply dividing the accelerating voltage by the number of atoms per cluster. This relationship establishes that very little of the energy of each atom is lost during the impact and disintegration of the clusters.

To establish the atom beam current of the beam 68, the apparatus was operated at an accelerating voltage of 10,000 volts, and produced argon clusters of about 2800 atoms per cluster. The incident angle alpha was 10 degrees, and the angle beta was 6 degrees. The energy per atom in the forwardly scattered beam was about 3.5 electron volts. The atom flux of neutral atoms was equivalent to a beam current of about 2 milliamps, with a flux density at 10 centimeters from the plate 60 equivalent to about 0.2 milliamps per square centimeter. By comparison, the flux density of a conventional ion beam at this same energy per atom would have been only about $10^{-5}$ milliamps per square centimeter, due to space charge effects that spread the beam.

The present invention therefore provides a highly effective approach and apparatus for producing a beam of energetic atoms, by first producing clusters of those atoms and then disintegrating the clusters. Although particular embodiments of the invention have been described in detail for purposes of illustration, various modifications may be made without departing from the spirit and scope of the invention. Accordingly, the invention is not to be limited except as by the appended claims.

What is claimed is:

1. A process for producing a beam of energetic atoms, comprising the steps of:

providing a beam containing energetic ionized clusters; and disintegrating the clusters of the beam to produce the beam of energetic atoms and energetic ions.

2. The process of claim 1, wherein the step of providing includes the steps of:

forming a beam containing uncharged clusters, ionizing the clusters of the beam, and accelerating the clusters of the beam to form the beam containing energetic ionized clusters.

3. The process of claim 1, wherein the step of providing includes the steps of:

forming a beam of unionized particles, the particles including atoms and clusters, ionizing the particles of the beam, accelerating the particles of the beam to form the energetic beam of ionized particles, and separating any the unionized particles from the beam containing the energetic ionized clusters.

4. The process of claim 3, including the further step of:

removing from the beam those particles outside a selected size range.

5. The process of claim 1, including the additional step, after the step of disintegrating, of separating the energetic ions from the beam of energetic atoms.

6. The process of claim 1, wherein the step of disintegrating includes the step of:

directing the ionized clusters of the energetic beam against a cluster scattering plate that is inclined to the axis of the beam, whereupon the clusters disintegrate to form the energetic atoms and the energetic ions.

7. The process of claim 6, wherein the cluster scattering plate is inclined at an angle of greater than zero and less than about 20 degrees to the axis of the beam.

8. A process for producing a beam of energetic atoms, comprising the steps of:

forming a beam containing uncharged clusters;

ionizing the clusters of the beam;

accelerating the clusters of the beam to form the beam containing energetic ionized clusters; and directing the ionized clusters of the energetic beam against a cluster scattering plate that is inclined to the axis of the beam, whereupon the clusters disintegrate to form the energetic atoms and the energetic ions.

9. Apparatus for producing a beam of energetic atoms, comprising:

a source of energetic ionized clusters; and means for disintegrating the clusters of the beam to form the beam of energetic atoms and energetic ions.

10. The apparatus of claim 9, further including means for supporting a target at a location such that the beam of energetic atoms and energetic ions impacts the target.

11. The apparatus of claim 9, further including a target supported in the means for supporting.

12. The apparatus of claim 9, wherein the source of energetic ionized clusters includes:

a source of a beam of unionized particles, the particles including atoms and clusters, an ionizer including a cathode and an anode adjacent the beam path, and a pair of apertured plates through which the beam passes, the plates have an accelerating voltage applied thereto.

13. The apparatus of claim 12, further including:

a deflection electrode that applies a field across the beam, so that the ionized particles are deflected and the unionized particles are not deflected.

14. The apparatus of claim 12, further including:

a mass separator electrode that applies a retarding potential to the beam, after the beam has passed through the ionizer.

15. The apparatus of claim 9, wherein the means for disintegrating includes:

at least one cluster scattering plate disposed to intercept the beam of energetic ionized clusters.

16. The apparatus of claim 15, wherein the angle between the plane of the cluster scattering plate and the beam is greater than zero and less than about 20 degrees.

17. The apparatus of claim 9, further including:

means for separating the energetic ions from the energetic atoms produced by the means for disintegrating.

* * * * *